United States Patent [19]

Choi et al.

[11] Patent Number: 4,496,191

[45] Date of Patent: Jan. 29, 1985

[54] SELECTIVE MINING FROM HORIZONTAL HOLES

[75] Inventors: Dai-Shik Choi; David L. McCain, both of Ponca City, Okla.

[73] Assignee: Conoco Inc., Ponca City, Okla.

[21] Appl. No.: 413,653

[22] Filed: Sep. 1, 1982

[51] Int. Cl.[3] ..... E21C 37/12

[52] U.S. Cl. ..... 299/17; 166/50; 299/19

[58] Field of Search ..... 299/4, 5, 17, 18, 19; 175/62, 67, 171; 166/50

[56] References Cited

U.S. PATENT DOCUMENTS

| | | | |
|---|---|---|---|
| 3,022,986 | 2/1962 | Brandt | 299/5 |
| 3,900,226 | 8/1975 | deJong | 299/17 |
| 4,076,311 | 2/1978 | Johns | 299/17 |
| 4,221,433 | 9/1980 | Jacoby | 299/4 |

FOREIGN PATENT DOCUMENTS

| | | | |
|---|---|---|---|
| 2206823 | 8/1972 | Fed. Rep. of Germany | 299/17 |

*Primary Examiner*—George A. Suchfield
*Assistant Examiner*—Michael Starinsky
*Attorney, Agent, or Firm*—William J. Miller

[57] ABSTRACT

A method for mining high grade ore from an ore body uses a near horizontal hole. The horizontal hole is bored into the ore body through as many of the high grade portions as possible. A jet mining tool is inserted into the hole to the high grade portion farthest from the tool insertion location and that portion of the high grade ore is removed. The tool is then pulled out of the hole until the jets are in a high grade portion which is adjacent the high grade portion previously mined and this portion is then jet mined. The process is repeated until all of the high grade portions of the ore body have been mined. The mined material is removed through the horizontally bored hole.

4 Claims, 2 Drawing Figures

SELECTIVE MINING FROM HORIZONTAL HOLES

PRIOR ART

Previous to this invention high portions of an ore body were generally removed in one of several ways. If the ore was close to the surface of the earth, the overburden was then removed and the low grade as well as the high grade ore was removed. This method proved extremely expensive since the majority of the ore may be low grade ore.

Another method was to run vertical pipes from the surface of the earth to the ore in question and remove the ore by solution mining if the ore is susceptible to being disolved. Otherwise the ore had to be removed by jet mining as illustrated in U.S. Pat. Nos. 3,951,457, Re. 29,021 and 3,880,470.

The problem with the above described prior art method is that jet pumps have a limited range and the material mined either needed to be soluble in the mining fluid, such as water, or it needed to be broken extremely fine so that it would be pumped to the surface. Since the jet mining tool has a limited range, many holes needed to be bored from the surface into the earth into the region to be mined, thus, substantially increasing the cost of mining.

Another method was to use the standard hydraulic mining methods as described in U.S. Pat. Nos. 4,094,549 and 4,023,862. In these patents the region to be mined was accessed by a shaft and horizontal tunnels were bored and the material mined by hydraulic mining apparatus. This method, however, is only successful and economical where the majority of the material is of a high grade since substantially all of the material necessarily must be removed. Furthermore the hydraulic jets have only a limited mining capability at the mine face. The maximum range of the jets in the mine is about 50 to 75 feet.

BRIEF DESCRIPTION OF THE INVENTION

This invention describes a method for mining the high grade portion only of an ore body economically and efficiently. The method basically comprises forming an access to the ore body by either digging a trench from the surface of the earth down to the ore body when the ore body is fairly near to the surface of the earth or digging a tunnel to the ore body using the usual mining techniques. A horizontal or substantially horizontal hole is then bored from the access through as many high grade portions as possible, the high grade portions being previously located in the usual manner. A jet mining tool is then inserted into the horizontal hole to the high grade ore portion farthest from the access and that high grade portion is then jet mined. The mined material flows out the horizontally bored hole to a sump where it is collected and separated from the mining fluid and the mining fluid is then returned to the jet mining tool. When the high grade portion is mined out, the tool is then pulled out to the point where it is in the next adjacent high grade portion. That high grade portion is then mined in the same method as previously described and the process is repeated until all high grade portions in the hole are mined. In this manner only the high grade portions are mined, and little of the low grade material is removed. Furthermore, nearly all of the high grade ore can be removed in this method described. As each horizontal bore hole mining operation is completed, an adjacent horizontal hole can be bored substantially parallel to the previous hole and the mining process repeated, thereby removing most of the high grade ore.

DETAILED DESCRIPTION OF THE FIGURES

Figure 1:
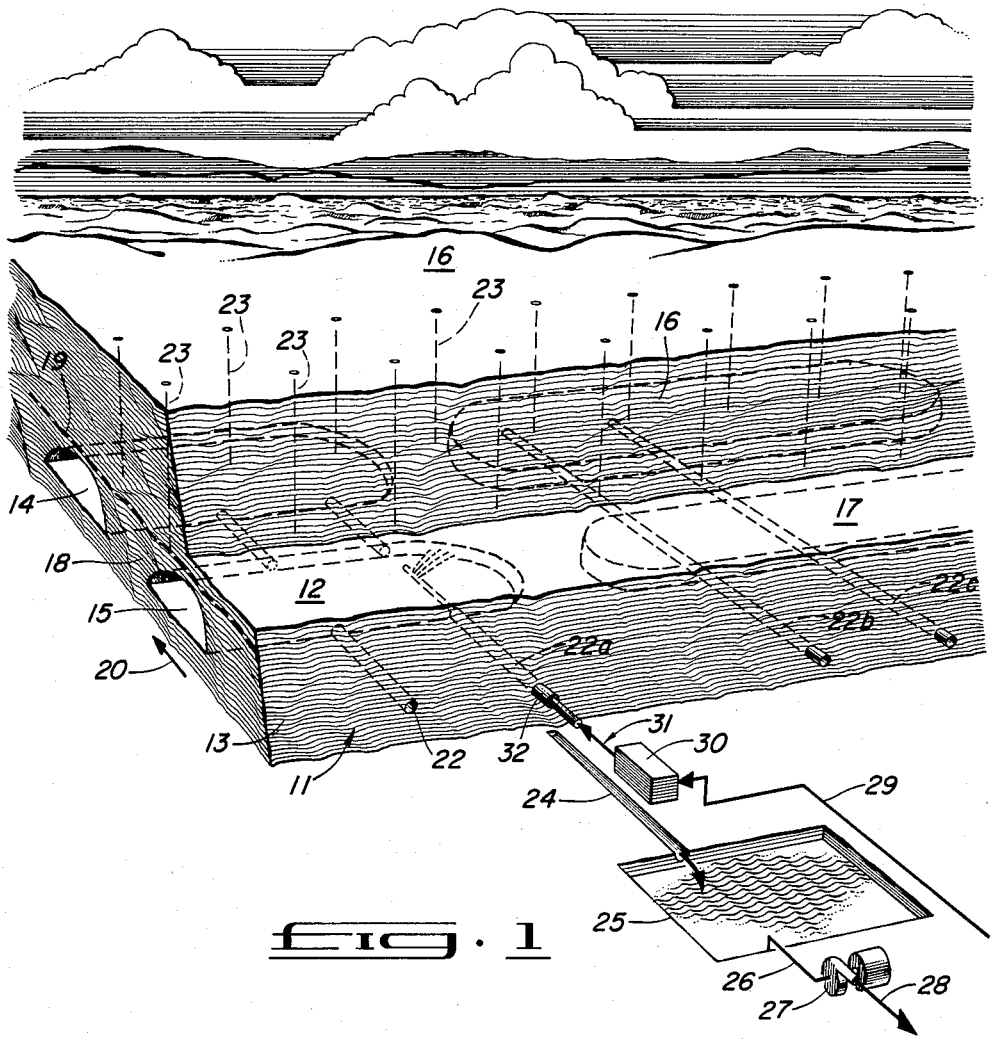
FIG. 1 is a perspective view of the hydraulic mining operation using a cross-section of the earth through the mined area.
Figure 2:
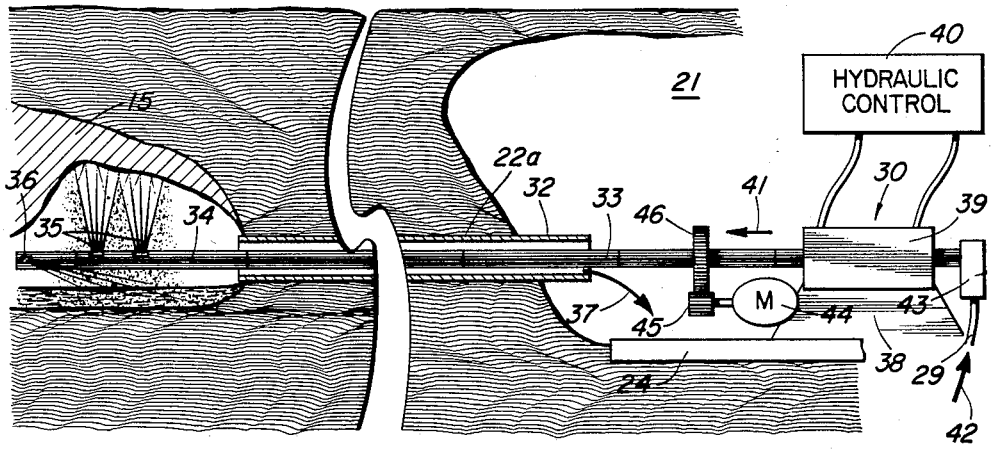
FIG. 2 is a side view of the mining operation substantially showh in FIG. 1 being performed in a tunnel rather than a trench.

Referring to FIGS. 1 and 2 a portion of the earth 10 has a trench 11 formed therein. Trench 11 may be formed in several steps 12 as is customary in surface mining. Trench 11 has a side wall 13. Within earth 10 are several high grade ore portions 14, 15, 16, and 17, for example. A low grade ore 18 may be located below the dotted line 19. Ordinarily, the usual surface mining technique would require the removal of the overburden from the surface of the earth 10 down to shelf 12 and then a second cut would need to be made through the ore body as illustrated by side wall 13. Normally, then, all of the ore would need to be removed by continually cutting away the overburden to shelf 12 and mining along face 13 in the direction of arrow 20. As the mining progressed a substantial portion of low grade ore would need to be mined before high grade portions 15 and 17 were reached. These high grade portions, as a matter of fact, could be quite small compared to the total amount of low grade ore in the ore body. Thus, the expense of mining would be prohibitive in most conditions.

In order to substantially reduce the mining cost and yet provide a method for removing all of the high grade ore, a system is devised whereby access is provided to the ore body, such as the trench 11, or, as illustrated, by mining tunnel 21 in FIG. 2. A horizontal hole 22, 22*a*, 22*b*, or 22*c* is bored into the low grade ore body 18 so that it penetrates as many of the high grade ore portions 15 and 14 in the case of hole 22, 15 and 14 in the case of hole 22*a*, 17 and 16 in the case of holes 22*b* or 22*c*. Each of these high grade ore bodies were previously located in any usual manner. In the case of uranium, the high grade ore could have been located by radiation detector means. In the case of other ores or uranium, the high grade ore could have been located by a plurality of holes 23 bored vertically from the surface of the earth down to the ore body 18 in a systematic manner so that the high grade portions can be located along with the regions where low grade ore is located. These holes also determine the height and bottom of the high grade portions so that the proper depth of trench 11 or tunnel 21 can be determined. When horizontal holes 22 through 22*c* are bored, it is preferable that they have a slight upward slope if possible so that the fluid or slurry will move freely from the mining area to the outside of the horizontal hole 22. Holes 22 should penetrate as many of the high grade portions 14 and 15, for example, as possible. The hole can be as long as several thousand feet. Thus, the intersection of the hole with many high grade portions should be possible. It is also preferable to have the hole close to the bottom of the high grade portions 14 and 15, for example, so that all of the high grade portion can be removed. It is also quite feasible that the hole be under the high grade portion so that not only can it have the proper clearance during the mining process but also that it can intersect as many as possible of the high grade portions and still have sufficient fluid velocity to remove the slurry formed during the jet mining process without clogging the hole. External to horizontal hole 22*a*, handling apparatus is provided. For example, trench 24 may be formed from the termination of the horizontal hole to a sump 25 where the slurry from the mining process is deposited. Material is removed from the sump by means of a pipe 26 connected to pump 27 where the outlet from pump 27 is coupled through pipe 28 to a separation plant, not illustrated. Once the fluid is separated from the ore, the fluid is returned through pipe 29 to the hydraulic pumping apparatus 30. It is then reinjected into the mine through jet mining equipment that will generally be referred to by number 31.

Referring specifically to FIG. 2 the jet mining apparatus is shown in more detail. The horizontal hole, for example 22*a*, may be cased using casing 32. The jet mining apparatus as well known in the art but generally consists of a pipe 33 which may have several sections joined together. A jet mining tool 34 is attached to the end of pipe 33 and comprises several jets 35 and may include a backflushing jet 36. Material which is mined will form a slurry and move down horizontal hole 22*a* or casing 32 in the direction of arrow 37 to trench 24. The basic requirements of the hydraulic tool comprise a mounting 38 which has a hydraulic ram 39 operated by a hydraulic control 40 which can move hydraulic ram 39 in either direction. For mining control 40 moves the ram 39 in the direction of arrow 41 on pipe 33. Jet mining fluid enters in the direction of arrow 42 through pipe 29 into a rotating coupling 43 and down pipe 33 to jets 35 and 36. Motor 44 is coupled through gears 45 and 46 to pipe 33 so that jets 35 can change their position as needed to fully mine the high grade ore.

OPERATION

The method of mining in accordance to this invention operates in the following manner:

As previously discussed, the high grade ore is located by any well known technique such as the trenching or vertical coring holes 33 so that the extent and quality of the ore can be determined as well as its thickness and maximum depth. A pattern is generally drilled utilizing several vertical holes so that the extent of the high grade ore can be located in all directions. The high grade ore is generally depth determined, and a trench 11 or tunnel 21, whichever is more economical, is formed. The trench or tunnel provides access to the ore so that a plurality of horizontal holes 22 through 22*c*, for example, can be bored. These holes are preferably bored slightly uphill so that the mined fluids can more readily be removed from the holes. As many of the high grade portions are intersected as possible with each horizontal hole 22. Such horizontal holes can be drilled as far as 2,000 feet with a high degree of accuracy, and with improved technology, distances much greater than the above should be obtainable. The holes can be bored below the ore body or into the ore body depending upon the inclination of the high grade ore body to the horizon. A single hole 22 may be bored and then, as needed, a second hole 22*a* through 22*c* may be bored or several holes may be bored at one time. Once the holes are bored, a jet mining tool 34 along with its pipe 33, is coupled to the jet mining apparatus 30, particularly the hydraulic ram 39 and gears 46 and 45. Fluid is then applied to the pipe 29, rotating coupling 43 into pipe 33 to jets 35 and 36. The jets then erode away as shown in FIG. 2. The material falls to the bottom of high grade portion 15 and is washed by means of the backflushing jets into horizontal hole 22*a* wherein it is expelled into trench 24 and sump 25. As the sump 25 fills, material is pumped through pump 27 and pipe 28 to the processing plant, not shown. The fluid or water is then separated from the mining high grade ore and returned through pipe 29 to the mining unit 30 where the process is continuously repeated.

In performing the mining operation the jet tool 34 is inserted into the hole 22 or 22*a* and moved as far as the hole is drilled away from the trench face 11 to the most remote high grade ore body penetrated by the horizontal hole. In the case of hole 22*a*, that would have been high grade portion 14. As illustrated in FIG. 1, high grade portion 14 was mined out first. Once all material was removed the jet tool 34 was moved back until it reached high grade portion 15. This portion was then mined in the manner previously described. If more high grade portions than that illustrated were present, the tool would be likewise moved to the next adjacent high grade portion to the one just mined and each high grade portion mined until all of the high grade portions are mined which are intersected by the horizontal hole 22.

In FIG. 1 hole 22 is illustrated as being completely mined in both high grade portions 14 and 15. Hole 22*a* is illustrated as being completely mined in high grade portion 14 and is in the process of mining out high grade portion 15. Neither horizontal holes 22*b* or 22*c* has been mined. Trench 24 can be dug to each of the holes 22*b* or 22*c* when the times comes to mine these holes. In the case of material which is not consolidated, casing 32 may need to be inserted. In case high grade portion 14 is being mined through hole 22*a*, the casing properly would have been inserted through portion 15 up to high grade portion 14 where the casing would have terminated at the beginning of high grade portion 14. The jet tool would then have been free to mine all of the high grade portion 14 without interference from the casing. When high grade portion 14 was completely mined, then the casing as well as the tool would need to be pulled back to the next succeeding mining operation. Thus casing 32 would need to be pulled back to the beginning of high grade portion 15 so that the tool could mine high grade portion 15 without interference from the casing.

It is obvious that changes can be made in the application and still be within the spirit and scope of the invention as disclosed in the specification and appended claims.

What is claimed is:

1. A method of selectively mining only the high grade portion of an ore body comprising:

(a) locating said high grade portions in said ore body;

(b) forming an access to said ore body of a depth and width to permit horizontally drilling into said ore body;

(c) boring a horizontal hole into said ore body so that said hole penetrates as many of said high grade portions as possible;

(d) providing casing in said horizontal hole except at the high grade portion farthest from the said trench;

(e) inserting a jet mining tool into the horizontally bored hole to the high grade portion farthest from the said trench;

(f) jet mining said high grade portion in a manner to slurry said mined material from said high grade portion of said ore out of said horizontally bored hole and casing;

(g) collecting said slurry material for further processing;

(h) moving said jet mining tool from said farthest location to the next adjacent high grade portion along said horizontally bored hole and removing the casing from that portion; and (i) repeating steps (f), (g) and (h) until all the located high grade portions are mined.

2. A method as described in claim 1 wherein said method is performed in a plurality of parallelly drilled horizontal holes in said ore body from said access.

3. A method as described in claim 1 or 2 wherein access is acquired by forming a trench.

4. A method as described in claim 1 or 2 wherein said access is acquired by forming a tunnel.

* * * * *